US006895615B2

(12) United States Patent
Dilascio

(10) Patent No.: US 6,895,615 B2
(45) Date of Patent: May 24, 2005

(54) IN-BED TOE TENT FRAME

(76) Inventor: Dennis Paul Dilascio, 12424 NE. 157 St., Woodinville, WA (US) 98072-7915

( * ) Notice: Subject to any disclaimer, the term of this patent is extended or adjusted under 35 U.S.C. 154(b) by 0 days.

(21) Appl. No.: 10/461,597

(22) Filed: Jun. 12, 2003

(65) Prior Publication Data

US 2003/0229942 A1 Dec. 18, 2003

Related U.S. Application Data

(60) Provisional application No. 60/388,176, filed on Jun. 13, 2002.

(51) Int. Cl.[7] ..... A47C 21/02

(52) U.S. Cl. ..... 5/505.1; 5/504.1

(58) Field of Search ..... 5/505.1, 504.1, 5/503.1

(56) References Cited

U.S. PATENT DOCUMENTS

| | | | | | |
|---|---|---|---|---|---|
| 1,072,490 | A | * | 9/1913 | Oilar | 5/505.1 |
| 1,175,526 | A | * | 3/1916 | Jones | 5/505.1 |
| 1,577,825 | A | * | 3/1926 | Jenness | 5/648 |
| 1,835,798 | A | * | 12/1931 | McKay | 5/505.1 |
| 2,106,834 | A | * | 2/1938 | Ewald | 5/505.1 |
| 2,210,255 | A | * | 8/1940 | Peevey | 5/505.1 |
| 2,235,191 | A | * | 3/1941 | Arnould | 5/505.1 |
| 2,300,898 | A | * | 11/1942 | Allen | 5/505.1 |
| 2,356,219 | A | * | 8/1944 | Coffing | 5/505.1 |
| 2,401,999 | A | * | 6/1946 | Wolfe | 5/505.1 |
| 2,524,469 | A | * | 10/1950 | Orford | 5/505.1 |
| 2,547,942 | A | * | 4/1951 | Hinton | 5/651 |
| 2,595,449 | A | * | 5/1952 | Coffing et al. | 5/505.1 |
| 2,598,295 | A | * | 5/1952 | Pelton | 5/505.1 |
| 2,602,171 | A | * | 7/1952 | Good | 5/505.1 |
| 2,611,139 | A | * | 9/1952 | Ecklund | 5/505.1 |
| 2,614,269 | A | * | 10/1952 | Hougham | 5/505.1 |
| 2,642,589 | A | * | 6/1953 | Cobb | 5/505.1 |
| 2,668,963 | A | * | 2/1954 | Drake | 5/505.1 |
| 2,674,750 | A | * | 4/1954 | Moore | 5/505.1 |
| 2,676,340 | A | * | 4/1954 | Garriott et al. | 5/505.1 |
| 2,710,414 | A | * | 6/1955 | Emery | 5/505.1 |
| 3,808,614 | A | * | 5/1974 | Reinhard | 5/505.1 |
| 4,570,275 | A | * | 2/1986 | Merriman | 5/505.1 |
| 4,644,599 | A | * | 2/1987 | Wolcott | 5/504.1 |
| 4,975,997 | A | * | 12/1990 | Misiura et al. | 5/505.1 |
| 5,203,042 | A | * | 4/1993 | Mason | 5/504.1 |
| 5,329,658 | A | * | 7/1994 | Fontenot et al. | 5/505.1 |
| D352,847 | S | * | 11/1994 | Station | D6/462 |
| 5,438,720 | A | * | 8/1995 | Daneshvar | 5/505.1 |
| 6,240,581 | B1 | * | 6/2001 | Pender | 5/505.1 |
| 2002/0170114 | A1 | * | 11/2002 | Wolcott | 5/488 |
| 2003/0229942 | A1 | * | 12/2003 | Dilascio | 5/505.1 |

FOREIGN PATENT DOCUMENTS

| | | | | | |
|---|---|---|---|---|---|
| AU | 000111326 | A | * | 9/1940 | 5/505.1 |
| GB | 000002269 | A | * | 12/1912 | 5/505.1 |

* cited by examiner

*Primary Examiner*—Robert G. Santos
(74) *Attorney, Agent, or Firm*—Dean A. Craine

(57) ABSTRACT

An in-bed toe tent frame designed to keep bedding off the toes of a person lying on his or her back on a standard bed. The frame includes a flat lower support frame which extends transversely across the bed between the mattress and box spring. The opposite ends of the lower support frame extend upward over the opposite sides of the mattress and selectively connect to two hub assemblies. The two hub assemblies hold an upper support frame in a transversely aligned, elevated position over the mattress. Bedding placed over the upper support frame is then elevated over the user's feet when sleeping. The hub assemblies allow the upper support frame to be adjusted to different heights to produce different tent sizes. The hubs also allow the upper support frame to be rotated toward the foot of the bed for compact storage.

5 Claims, 4 Drawing Sheets

IN-BED TOE TENT FRAME

This utility patent application claims the priority date of the provisional patent application Ser. No. 60/388,176 filed Jun. 13, 2002.

BACKGROUND OF THE INVENTION

1. Field of the Invention

The present invention relates generally to the field of devices that attach to beds to improve the comfort of the bed occupant and, more particularly, to devices that maintain sheets in a certain position in relation to the bed.

2. Description of the Related Art

While sleeping in a bed, an individual's entire body is usually covered by a sheet, one or more blankets, and a bed cover or comforter. Usually, the bedding is pulled tightly over the bed so that the bedding presses downward onto the user's body. Some individuals find tight bedding on a bed uncomfortable as it is too restrictive to the feet and the lower legs.

What is needed is a simple device that easily and quickly attaches to a bed that can be used to elevate the bedding to form a tent structure (called a toe tent) around the user's feet or lower legs. Such a device should be easy to use, adjustable for different bed sizes, and adjustable for different foot sizes. Such a device should also be sufficiently durable and relatively inexpensive to manufacture.

SUMMARY OF THE INVENTION

It is an object of the present invention to provide a device that maintains bedding off of the toes of a user while the user is lying on his or her back in a bed.

This and other objects of the present invention are met by the in-bed toe tent frame disclosed herein comprising a length-adjustable lower support frame that fits between the mattress and box spring on a bed. Adjustable hub assemblies are perpendicularly aligned and attached to the opposite ends of the lower frame support. When the device is properly assembled on a bed, the hub assemblies extend upward from the ends of the lower support frame on opposite sides of the mattress and are designed to selectively connect to the opposite ends of a U-shaped upper support frame that extends transversely over the mattress. The upper support frame includes two L-shaped end support rods that are joined together via a middle connection rod. The length of the end support rods is sufficient so that the upper support frame is sufficiently elevated above the mattress so that bedding placed over the upper support frame does not contact the user's toes when lying on the bed.

The hub assemblies are adjustable to allow the user to adjust the elevation of the upper support frame and allow the hub assemblies to be rotated on the sides of the mattress into a stored position when the toe tent frame is not needed.

DESCRIPTION OF THE PREFERRED EMBODIMENT(S)

Figure 1:
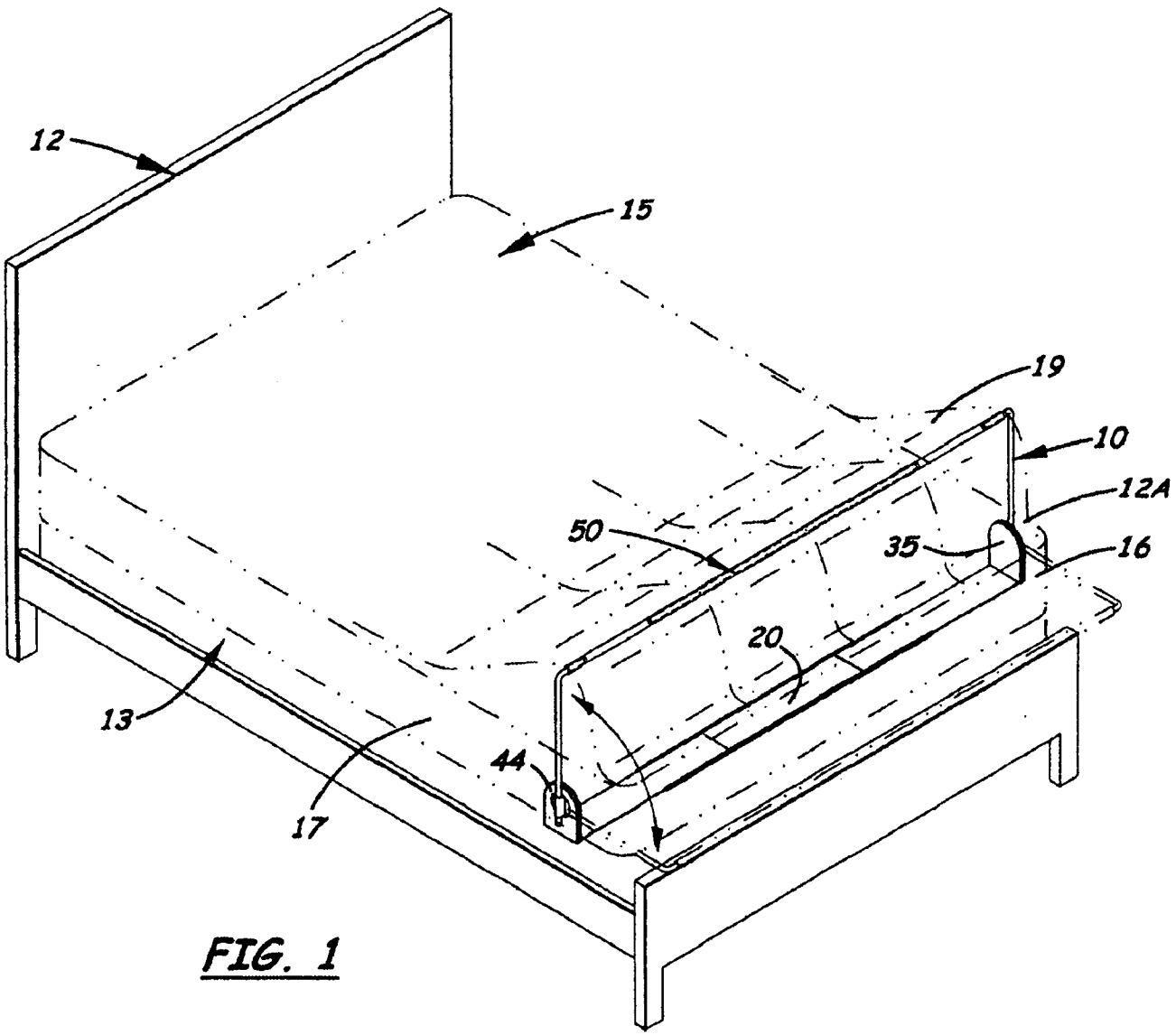
FIG. 1 is a perspective view of a queen-size bed with the in-bed toe tent frame assembled near the foot of the bed.

The in-bed toe tent frame 10, shown in FIG. 1, is used to selectively elevate the bedding 19 located near the foot 12A of a bed 12 to prevent the bedding 19 from contacting the user's toes when laying on his or her back while sleeping. The tent frame 10 is designed to collapse or be easily removed so that bedding 19 may lay flat across the bed 12 like a normal bedding when the tent frame 10 is not in use.

The tent frame 10 includes a lower support frame 20 that extends transversely between the box spring 13 and mattress 15. Attached to the opposite ends 20A, 20B of the lower support frame 20 are two adjustable hub assemblies 35, 44, respectively, that extend upward over the opposite sides 16, 17 of the mattress 15 and connect to an upper support frame 50. The upper support frame 50 extends transversely across the mattress 15 in an elevated position directly over the lower support frame 20 to lift and support the bedding 19 over the user's feet.

Figure 2:
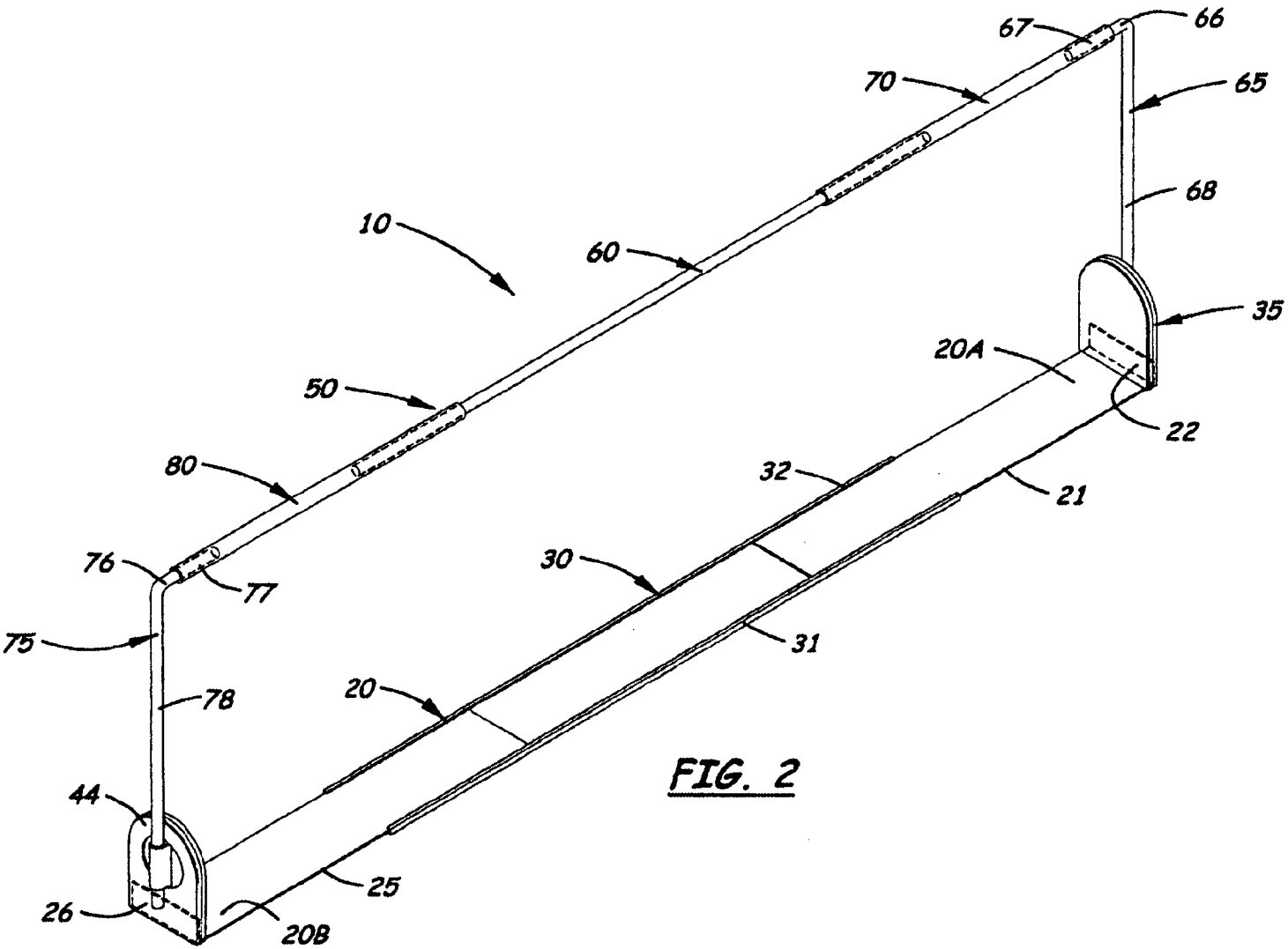
FIG. 2 is a perspective view of the in-bed toe tent frame.

As shown in FIG. 2, the lower support frame 20 is an elongated, flat, low profile structure designed to fit between the box spring 13 and mattress 15. The lower support frame 20 includes a central straight joining member 30 with two longitudinally aligned front and rear channels 31, 32, respectively, formed thereon. Longitudinally aligned on opposite sides of the joining member 30 are two straight support plates 21, 25. During assembly, the two support plates 21, 25 slidingly attach to the two channels 31, 32, thereby enabling the overall length of the lower support frame 20 to be selectively adjusted. The two channels 31, 32 provide a friction connection between the two support plates 21, 25, thereby maintaining the lower support frame 20 in a desired length. It should be understood that other means may be used to allow the lower support frame 20 to be selectively adjusted in length and then temporarily fixed in a desired length.

Figure 3:
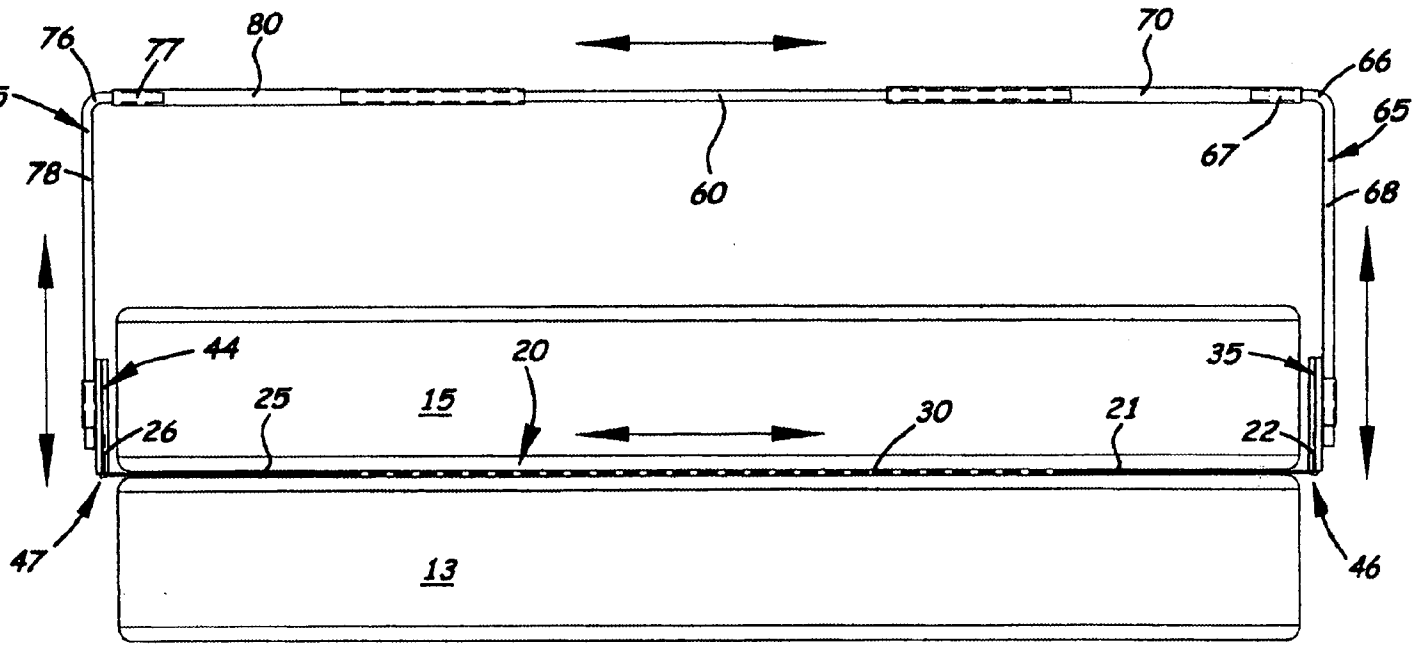
FIG. 3 is a front plan view of a bed with the in-bed toe tent frame assembly thereon.
Figure 4:
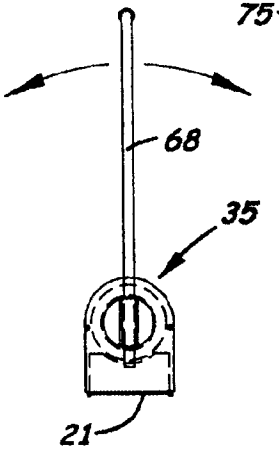
FIG. 4 is a side elevational view of the invention showing the movement of the upper support frame.

Formed on the distal end of each support plate 21, 25 is a perpendicularly aligned short tab member 22, 26, respectively. During assembly, the tab members 22, 26 slide into slots 46, 47 (see FIG. 3) formed on the end of the hub assemblies 35, 44 to hold the hub assemblies 35, 44 on the lower support frame 20. In the preferred embodiment, the lengths of the joining member 30 and the two support plates 21, 25 are sufficient so that the overall length of the lower support frame 20 may be selectively adjusted to fit a single to king-size bed.

The upper support frame 50 includes two L-shaped end support rods 65, 75 that connect to two outer connecting tubes 70, 80. Each L-shaped end support rod 65, 75 includes a short upper leg 66, 76, respectively, and a long lower leg 68, 78, respectively, perpendicularly aligned thereto. Attached to the end of each short upper leg 66, 76 is an adapter 67, 77 that threadingly connects the distal end of the short upper leg 66, 76 to an outer connection tube 70, 80, respectively. Disposed between the two outer connection tubes 70, 80 is a middle rod 60 that is slightly smaller in diameter than the outer connection tube 70, 80, thereby enabling the middle rod 60 to slide freely inside the outer connection tubes 70, 80. During use, the overall length of the upper support frame 50 is adjusted in length to fit a single to king-size bed.

Figure 6:
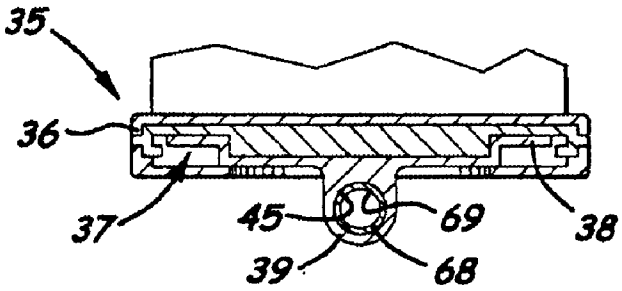
FIG. 6 is a sectional top plan view of the hub assembly.
Figure 7:
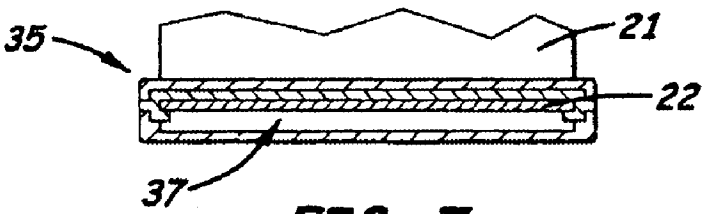
FIG. 7 is a sectional top plan view of the hub assembly taken along line 7—7 in FIG. 5.
Figure 5:
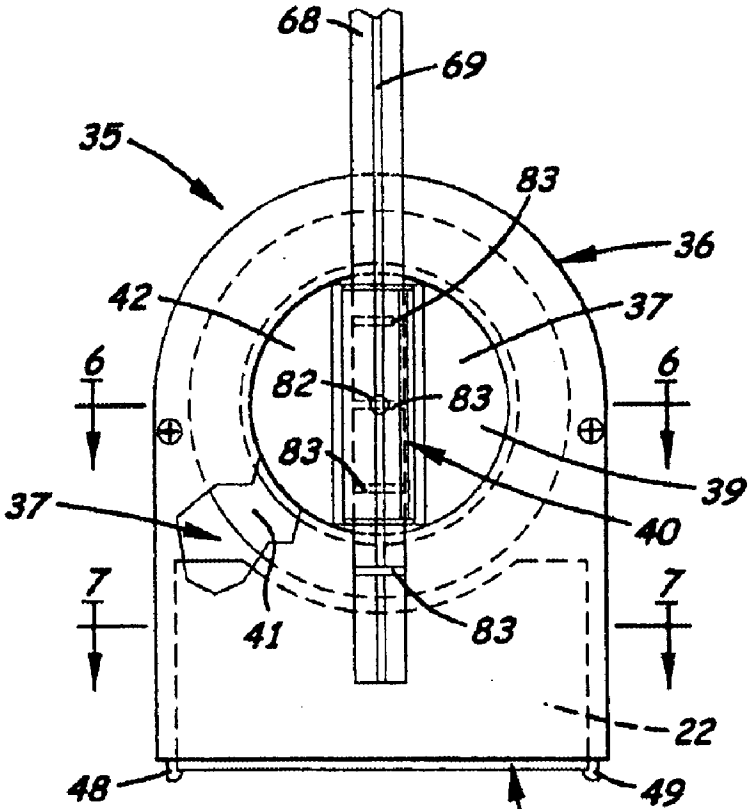
FIG. 5 is a front elevational view of a hub assembly.

FIG. 5 is a front elevational view of a hub assembly (hub assembly 35 shown). It should be understood that hub assembly 44 is the mirror-image of hub assembly 35 and includes the same structures and functions in the same manner. Each hub assembly 35, 44 includes a hollow body 36 with a center cavity 37. As shown in FIG. 6, formed on the outer surface of the body 36 is a circular dial opening 38. Located inside the center cavity 37 is a rotating dial 39 with a leg receiving member 40 formed thereon that extends through the dial opening 38. The dial 39 includes a large circular base plate 41 that is housed and retained inside the body 36. Formed centrally on the base plate 41 is an outward extending cylindrical neck 42. Formed on the outer surface of the neck 42 is the leg receiving member 40. In the preferred embodiment, the leg receiving member 40 has a one-half inch diameter tube that receives the lower leg (lower leg 68 shown) on the adjacent end support rod (end support rod 65 shown). The body 36 measures approximately nine inches in length, five and one-half (5.5) inches in width, and ⅝ inch in thickness.

As mentioned above, and as shown in FIG. 3, each body 36 includes a lower slot 46 into which the tab member 22 on the adjacent lower support plate 21 extends. Extending downward from the front and rear perimeter edges of the body 36 are two biasing ears 48, 49 that engage the lower surface of the lower support plate 21. During use, the ears 48, 49 catch the edges of the adjacent lower support plate 21 to lock the body 36 onto the lower support plate 21. The leg receiving member 40 on the dial 39 is designed to receive the lower leg 68, 78 of the end support rod 65, 75, respectively. As also shown in FIG. 5, formed centrally on the rotating dial 39 is a laterally extending tip 82. The tip 82 is sufficient in length to extend into a notch 83 located in the leg receiving member 40. During assembly, the position of the lower legs 68, 78 are adjusted on the leg receiving member 40 so that the tip 82 engages one of the notches 83 formed on the inside surface of the lower leg 68, 78. When the tip 82 engages one of the notches 83, the lower leg 68 or 78 is locked in position on the hub assembly 35, 44, respectively. In the preferred embodiment, each leg receiving member 40 also includes a longitudinally aligned tab 45 that is inserted into a groove 69 formed on the lower leg 68 that prevents the upper support frame 50 from twisting between the two hub assemblies 35, 44.

In the preferred embodiment, the joining member 30 is made of plastic and is approximately six inches in width, 36 inches in length, and made of three pieces of vinyl coated polyester (20 mil) placed one on top of the other and are sewn down the sides, forming a three layer rectangular structure. The lower support plates 21, 25 are made of 5052 grade sheet aluminum, measuring 0.0625 inches in thickness and measure approximately five and one-half (5.5) inch in width and thirty eight (38) inches in length. Each lower support plate 21, 25 has an effective length of approximately thirty-five (35) inches. The tab members 22, 26 measure approximately three (3) inches in length. The support plates 21, 25 may be painted or powder coated as part of the metal finishing process. The edges of the adjoining structures are rounded and de-burred to prevent any snagging or tearing of sheets or bedding.

The end support rods 65, 75 are made of 6061 grade aluminum, measuring approximately one-half (½) inch in outer diameter. The short upper legs 66, 76 each measure approximately two and one-half (2½) inches while the lower legs 68, 78 each measure approximately eighteen (18) inches in length. The notches on the inside surface of the lower legs 68, 78 are spaced apart approximately one (1) inch.

The outer connecting tubes 70, 80 are made of 6061 aluminum and measure, approximately three-eighths (⅜)inch in diameter, and thirty-six (36) inches in length. The two outer connecting tubes 70, 80 are approximately one-half (0.5) inch outer diameter, with a 0.0625 wall thickness, giving a three-eights (⅜) inch inner diameter through which the middle rod 60 may slide. The lengths of the outer connecting tubes 70, 80 and middle rod 60 are thirty-five (35), thirty-one (31), and thirty-one (31) inches, respectively.

During use, the lower support frame 20 is assembled and adjusted in length so that it may be disposed between the box springs 13 and the mattress 15 with the two hub assemblies 35, 44 located adjacent to the opposite sides 16, 17 of the bed 12. The hub assemblies 35, 44 are connected to the lower support frame 20 with the dials 39 facing outward. The dials 39 are then rotated on each hub assembly 25, 44 so that the leg receiving members 40 are aligned vertically to receive a lower leg 68, 78 on an end support rod, 65, 75, respectively. The upper support frame 50 is then assembled so that its overall length matches the overall length of the lower frame member 20. The ends of the lower leg 68, 78 on the end support rods 65, 75 are then inserted into the leg receiving members 40. The height of the upper support frame 50 is then adjusted by engaging the tip 82 into a desired notch 83 on the lower leg 68, 78. Once the upper support frame 50 is assembled and set at its proper height, the bedding 19 can then be placed over the tent frame 10.

When the tent frame 10 is no longer in use, the dials 39 may be rotated 90 degrees so that the upper support frame 50 is disposed over the end of the mattress as shown in FIG. 1. Alternatively, the upper support frame 50 may be disconnected and removed from the bed. Because the upper frame member 50 is made of smaller components that are assembled, the overall size of the upper frame member 50 when disassembled into its separate components is relatively small.

In compliance with the statute, the invention described herein has been described in language more or less specific as to structural features. It should be understood, however, that the invention is not limited to the specific features shown, since the means and construction shown is comprised only of the preferred embodiments for putting the invention into effect. The invention is therefore claimed in any of its forms or modifications within the legitimate and valid scope of the amended claims, appropriately interpreted in accordance with the doctrine of equivalents.

What is claimed is:

1. An in-bed toe tent frame, comprising:

a. a length adjustable U-shaped upper support frame including two longitudinally aligned L-shaped end support rods, each said support rod being selectively connected to an outer connection tube, each said connection tube being joined together via a middle connection rod, said middle connection rod and said end support rods being sufficient in length so that when longitudinally aligned and telescopically joined together, the overall length of said upper support frame may be adjusted to extend transversely over a bed;

b. a length adjustable lower support frame, said lower support frame being sufficient in length to extend transversely under a mattress on a bed;

c. two rotating hub assemblies perpendicularly aligned and attached to the opposite ends of said lower support frame; and, d. means for connecting the opposite ends of said upper support frame to said hub assemblies.

2. The in-bed toe tent frame, as recited in claim 1, wherein said lower support frame includes a joining member and two longitudinally aligned support plates, said support plates able to move telescopically over said joining member to adjust the overall length of said lower support frame.

3. The in-bed toe tent frame, as recited in claim 2, further including a tab member perpendicularly aligned on each said support plate that connects to one said hub assembly to attach said hub assembly thereto.

4. The in-bed toe tent frame, as recited in claim 1, wherein said means for connecting said upper support frame to said hub assembly is a leg receiving member that selectively receives a vertical leg on said end support rod.

5. The in-bed toe tent frame, as recited in claim 4, wherein said leg receiving member is attached to a rotating dial located on each said hub assembly.

* * * * *